US007234381B2

(12) United States Patent
Granger

(10) Patent No.: US 7,234,381 B2
(45) Date of Patent: Jun. 26, 2007

(54) DISPENSING APPLIANCE FOR WIPING MATERIAL

(76) Inventor: Maurice Granger, 17 rue Marcel Pagnol, Saint Priest en Jarez (FR) 42270

( * ) Notice: Subject to any disclaimer, the term of this patent is extended or adjusted under 35 U.S.C. 154(b) by 388 days.

(21) Appl. No.: 10/766,509

(22) Filed: Jan. 28, 2004

(65) Prior Publication Data

US 2004/0188486 A1 Sep. 30, 2004

Related U.S. Application Data

(63) Continuation of application No. PCT/FR02/02129, filed on Jun. 20, 2002.

(30) Foreign Application Priority Data

Aug. 3, 2001 (FR) ..... 01 10560

(51) Int. Cl.
*B26D 7/00* (2006.01)
*B26F 3/02* (2006.01)

(52) U.S. Cl. ..... 83/649; 83/337; 83/332; 83/342; 83/345; 225/2; 225/16; 225/93; 225/96; 242/564

(58) Field of Classification Search ..... 83/335, 83/337, 649, 937, 322, 345, 650, 342; 225/93, 225/6, 16, 12, 2, 34, 96; 242/564, 55.3, 553, 242/596

See application file for complete search history.

(56) References Cited

U.S. PATENT DOCUMENTS 2,278,029 A * 3/1942 Walsh et al. ..... 83/345
4,404,880 A * 9/1983 DeLuca ..... 83/42
4,846,035 A * 7/1989 Granger ..... 83/337
5,836,862 A * 11/1998 Granger ..... 493/459
6,363,824 B1 * 4/2002 Granger ..... 83/334
6,450,076 B1 * 9/2002 Granger ..... 83/334
6,684,751 B2 * 2/2004 Kapiloff et al. ..... 83/649
2001/0045149 A1 * 11/2001 Granger ..... 83/335
2002/0030075 A1 * 3/2002 Granger ..... 225/16
2002/0152871 A1 * 10/2002 Granger ..... 83/649

FOREIGN PATENT DOCUMENTS

FR 2 792 625 10/2000
WO WO 95/23677 9/1995

* cited by examiner

*Primary Examiner*—Boyer D. Ashley
*Assistant Examiner*—Ghassem Alie
(74) *Attorney, Agent, or Firm*—Heslin Rothenberg Farley & Mesiti P.C.; Jeff Rothenberg, Esq.

(57) ABSTRACT

Wiping material dispenser apparatus includes a basic housing that receives an articulated cover and a cartridge including two transverse flanges. An upper part of the flanges receives a roll of material and a lower part thereof receives a first blade-holder drum and a second return drum, the drums receiving crown wheels for the connection thereof. The return drum receives a third crown wheel that co-operates with the drum rotation actuation mechanism which includes a fixed cam. The blade-holder arm is provided with transmission means that involve the use of a mobile cam which actuates the cutting blade. The fixed and mobile cams co-operate with one another, defining the trajectory of the cutting blade.

19 Claims, 7 Drawing Sheets

Figure 1:
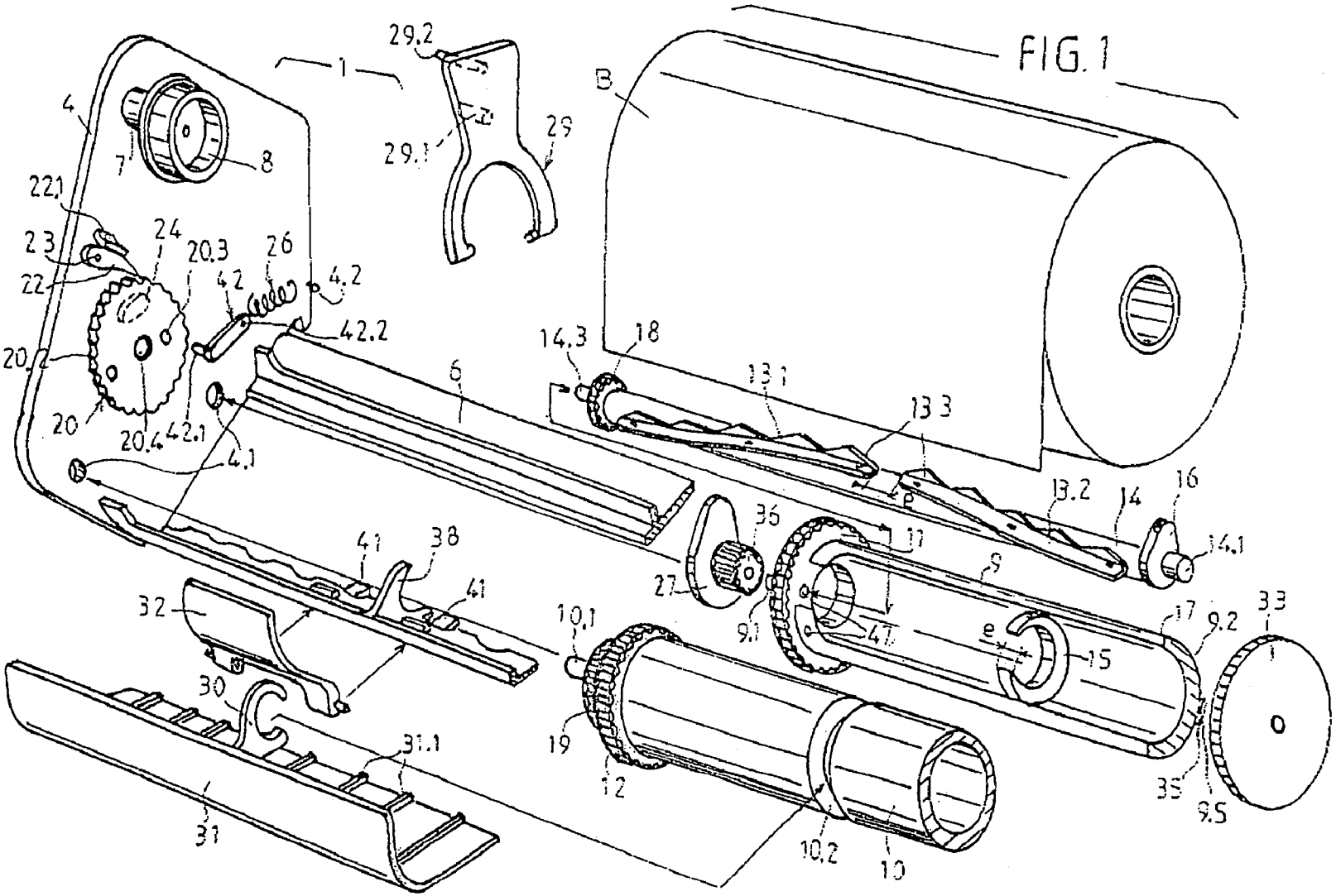

B
1
4
4.2
7
8
6
26
42
42.2
42.1
20.3
24
20.4
20
20.2
22.1
23
22
29
29.1
29.2
18
14.3
13.1
13.2
13.3
14
14.1
16
17
9.2
9.5
35
33
15
e
S
11
41
9.1
36
27
10
10.2
12
10.1
19
38
41
31.1
30
32
31

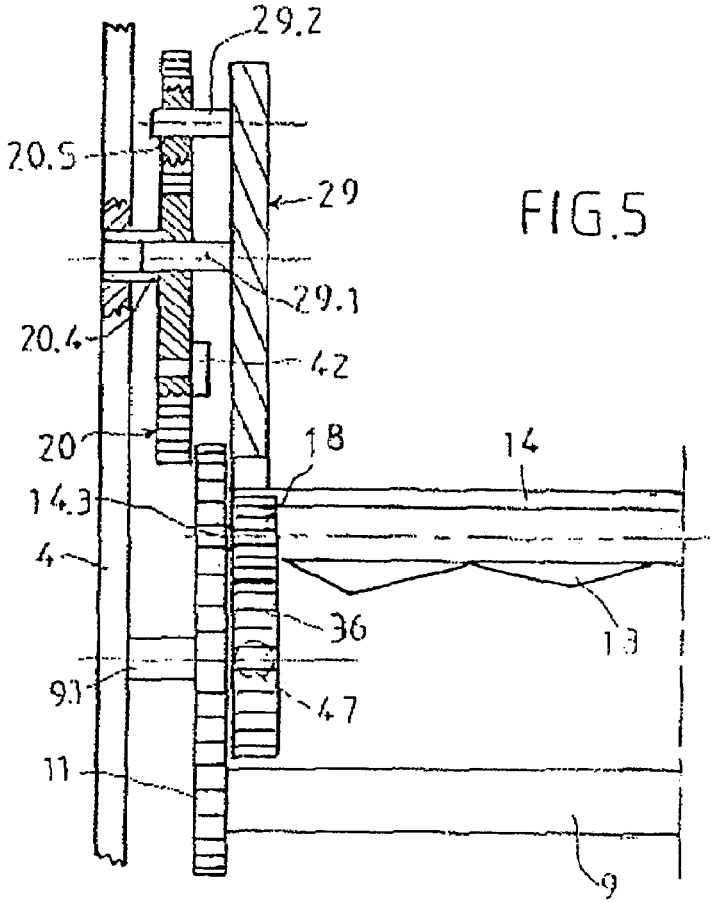
FIG.5
FIG.4
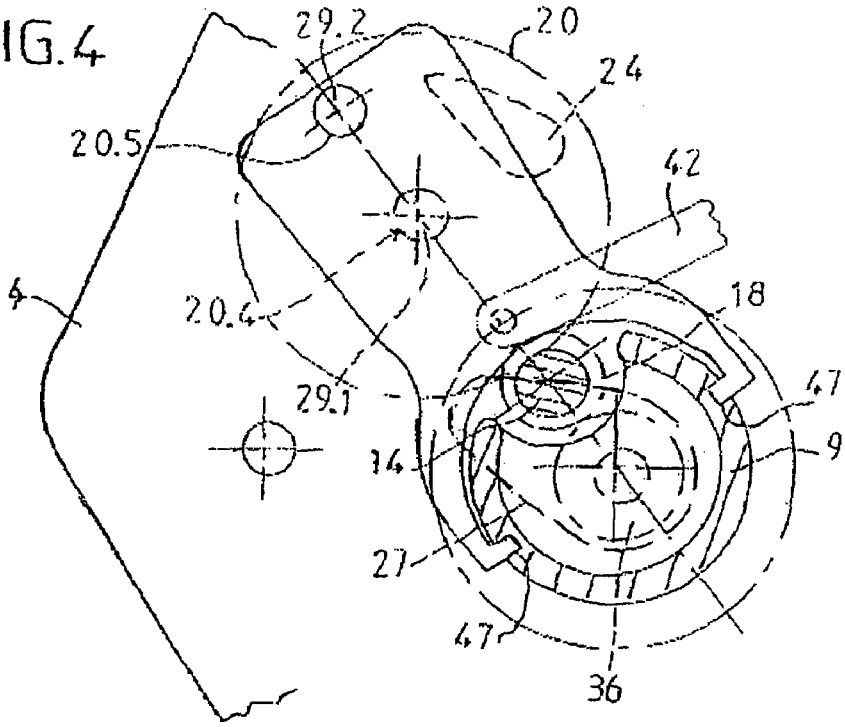

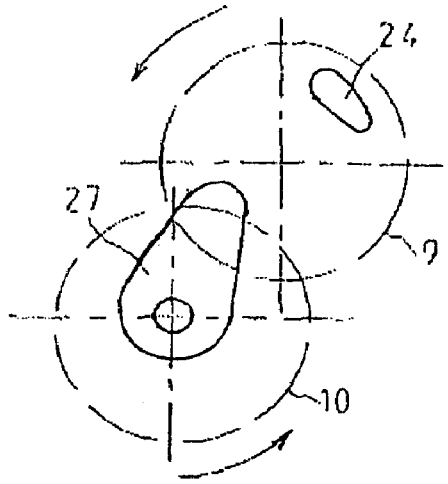
FIG.7
FIG.9
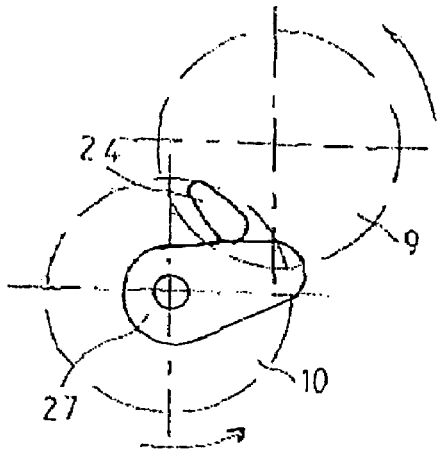
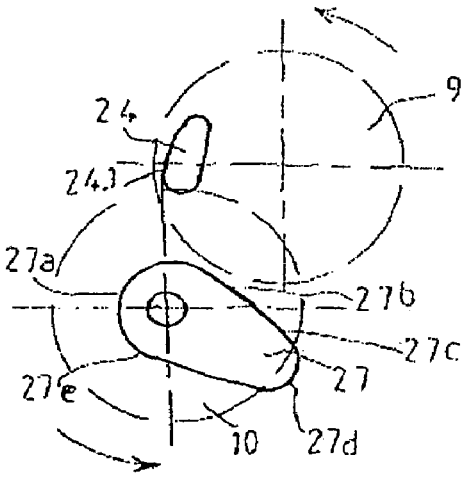
FIG.8
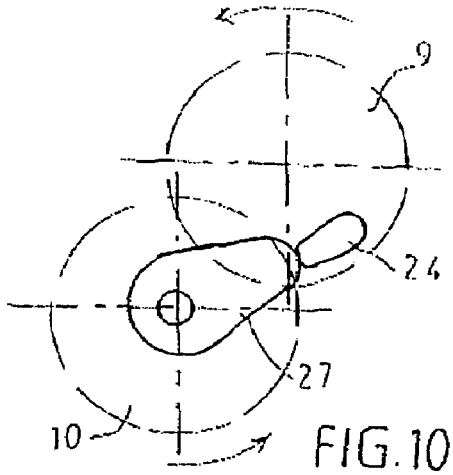
FIG.10

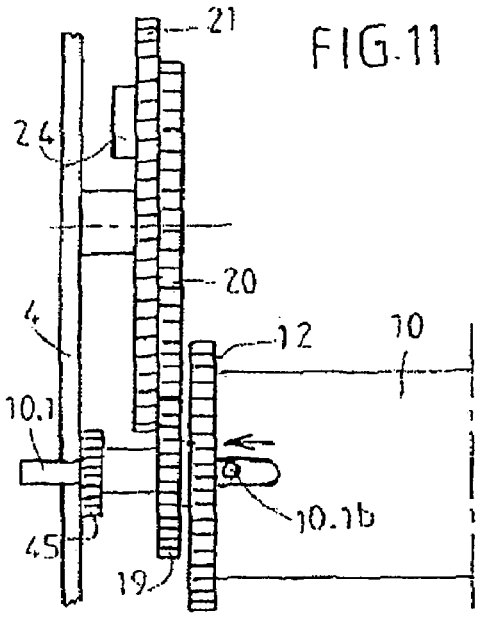
FIG.11
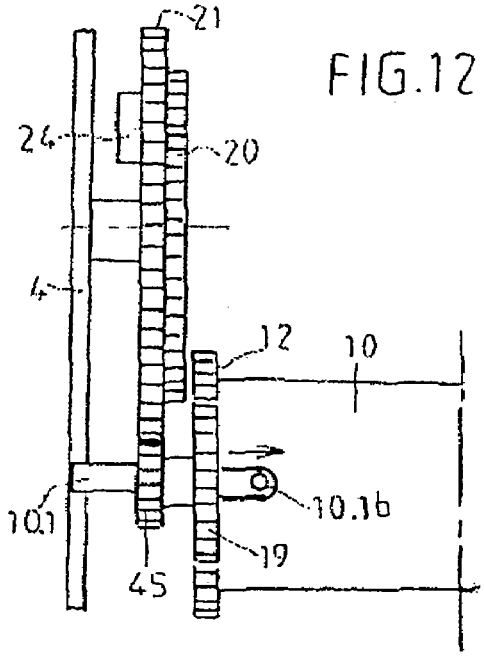
FIG.12
FIG.13
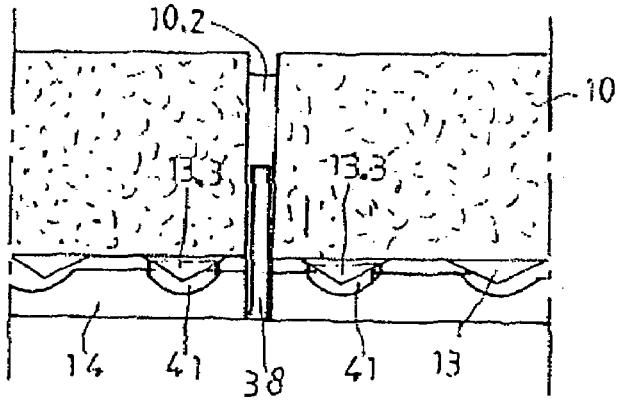

DISPENSING APPLIANCE FOR WIPING MATERIAL

CROSS REFERENCE TO RELATED APPLICATIONS

This application is a continuation of international application PCT/FR02/002129 filed on Jun. 20, 2002 and published in French as WO 03/013332 A1 on Feb. 20, 2003, and claims priority of French patent application number 01 10560 filed on Aug. 3, 2001, the entire contents of these applications is hereby incorporated by reference herein.

The invention relates to the technical field of automatically cutting dispensing appliances for wiping material of the wadded paper type for uses as hand wipes and toilet paper and for wiping and cleaning in general.

The applicant has developed numerous appliances of this type which conventionally comprise a housing, a cover, and a drum with an integrated cutting blade, said blade being capable of emerging from the drum during operation by virtue of means for the starting and return of the drum, including an eccentric and a return starting spring which are arranged so as to commence from a lateral side of the drum. Lateral flanges of the housing are designed to support the reel of material which comes to bear on the drum either directly, according to the teaching of the patent FR 2,332,215, or in a plane above the drum, without contact with the latter, as, for example, in the embodiment described in the patent FR 99 13691. In this specific embodiment, a press roller is capable of ensuring pressure on the strip of material at a given location, in addition to a second pressure zone defined toward the cutting zone of the strip of material in the region of the drum.

According to the prior art developed by the applicant through his many patents, the loading reel can be mounted either so as to bear on the drum receiving the cutting mechanism or so as to be in a plane above the drum and without contact with the latter. In this case, it is necessary to use a press roller which comes to bear on the drum and which makes it possible to tension the strip of material to be cut. In all these cases, the reel of material must be offered in a particular direction, in such a way that the strip of material comes from the front of the appliance in order subsequently to be introduced between the drum and the reel or the drum and the press roller. There is no possible alternative to the position of the reel, since the appliance would not operate. This type of appliance is in very widespread use throughout the world, so that its optimized implementation conforms perfectly to the requirements of the market and to the conditions under which the user pulls the end of the strip of material.

There are, nevertheless, some limits to the use of this type of appliance, such as are afforded, for example, by the method of loading of the reel or by the very large overall size of the appliance. The latter disadvantage is extremely detrimental to some uses, especially in domestic use. The reduction in volume of the appliance does not necessarily entail the reduction in the dimensions of its components, since the functionalities require a high-performance cutting device with a clean cut of the strip of material, for each given cutting format.

Nor has the prior art beyond the applicant made it possible, either, to satisfy the requirements of miniaturized automatically cutting dispensing appliances.

The applicant's approach was, therefore, to seek a novel type of radically different appliance which eliminates some essential components of the prior art, in order to propose a dispensing appliance of small volume, with a reduction of the order of approximately 30 to 40% in relation to the equipment existing on the market at the present time.

The applicant's approach was therefore to provide a novel dispensing appliance redesigned entirely in terms of its structure and components, which is capable of and functional for the automatic cutting of strips of material under the conditions desired by the users.

Another object sought by the applicant was then to standardize some common components of the appliance in order to allow cutting according to different formats of strips of material.

These objects and yet others will emerge clearly from the rest of the description.

According to a first characteristic, the automatically cutting dispensing appliance for wiping material, of the type comprising a basic housing with a back face and a lower face and receiving an articulated lid, is notable in that the housing receives, demountably by latching, a cartridge defining a carrier structure comprising two transverse flanges, a connecting plate arranged between said flanges, and a front spacer bar, the flanges receiving, in their upper part, connectors for supporting the reel of material and, in their lower part, two drums arranged side by side, without direct contact between them, the first drum being the blade carrier drum, the second drum being the guide drum, and in that said drums are designed, at one of their ends facing one another, for receiving toothed rings allowing their connection and their rotation with respect to one another, and in that the drum is designed for receiving a third toothed ring cooperating with the mechanism for starting the rotation of the drums, said mechanism including a fixed cam, and in that the blade carrier arm is designed with transmission means making it possible to implement the functioning of a movable cam allowing the emergence of the cutting blade from said drum, and in that the fixed and movable cams cooperate with one another, at the same time defining the path of the cutting blade, and in that flaps ensure the guidance of the strip of material in the appliance for the purpose of cutting said strip of material according to a specific format.

Figure 2:
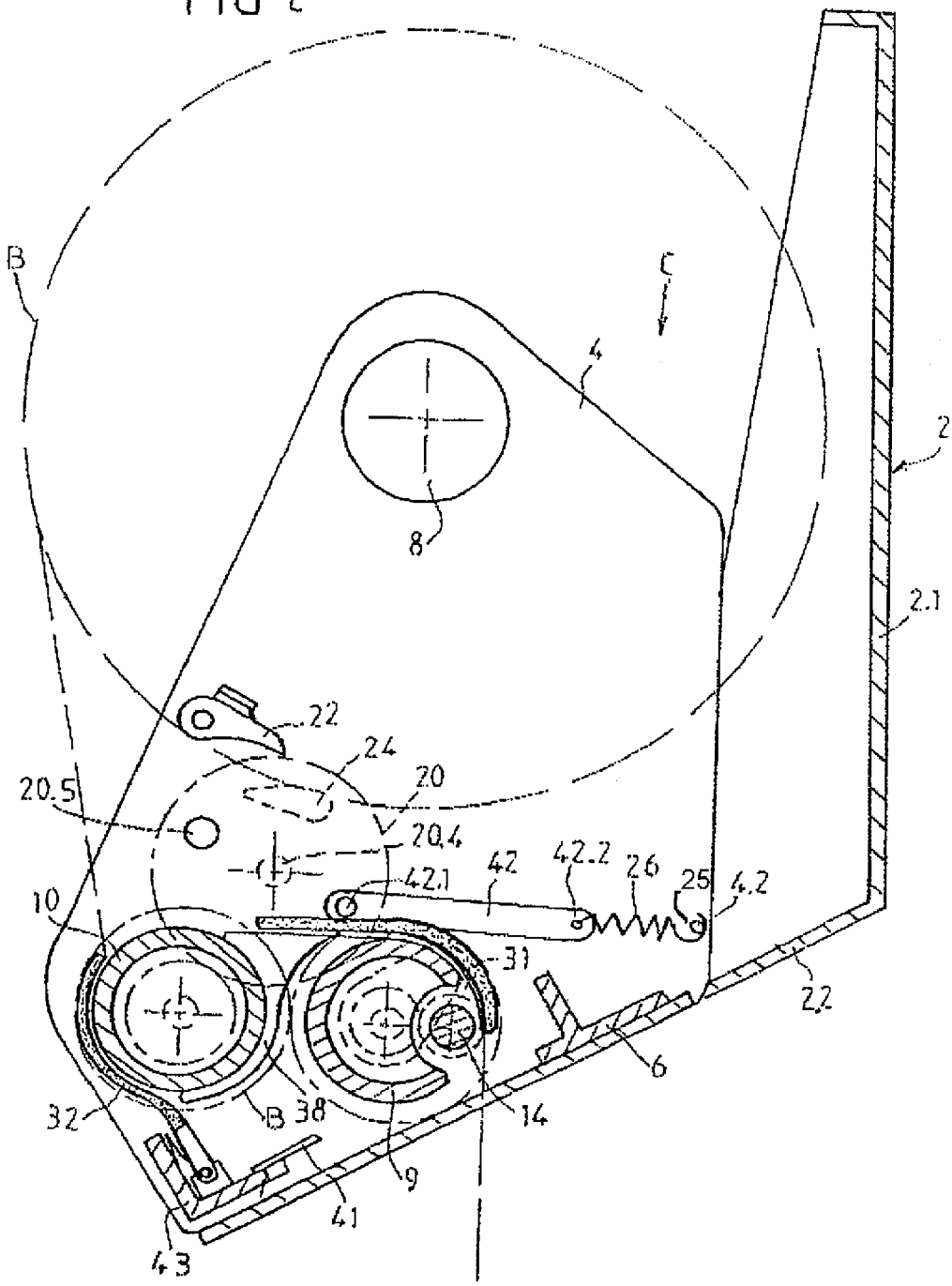
Figure 3:
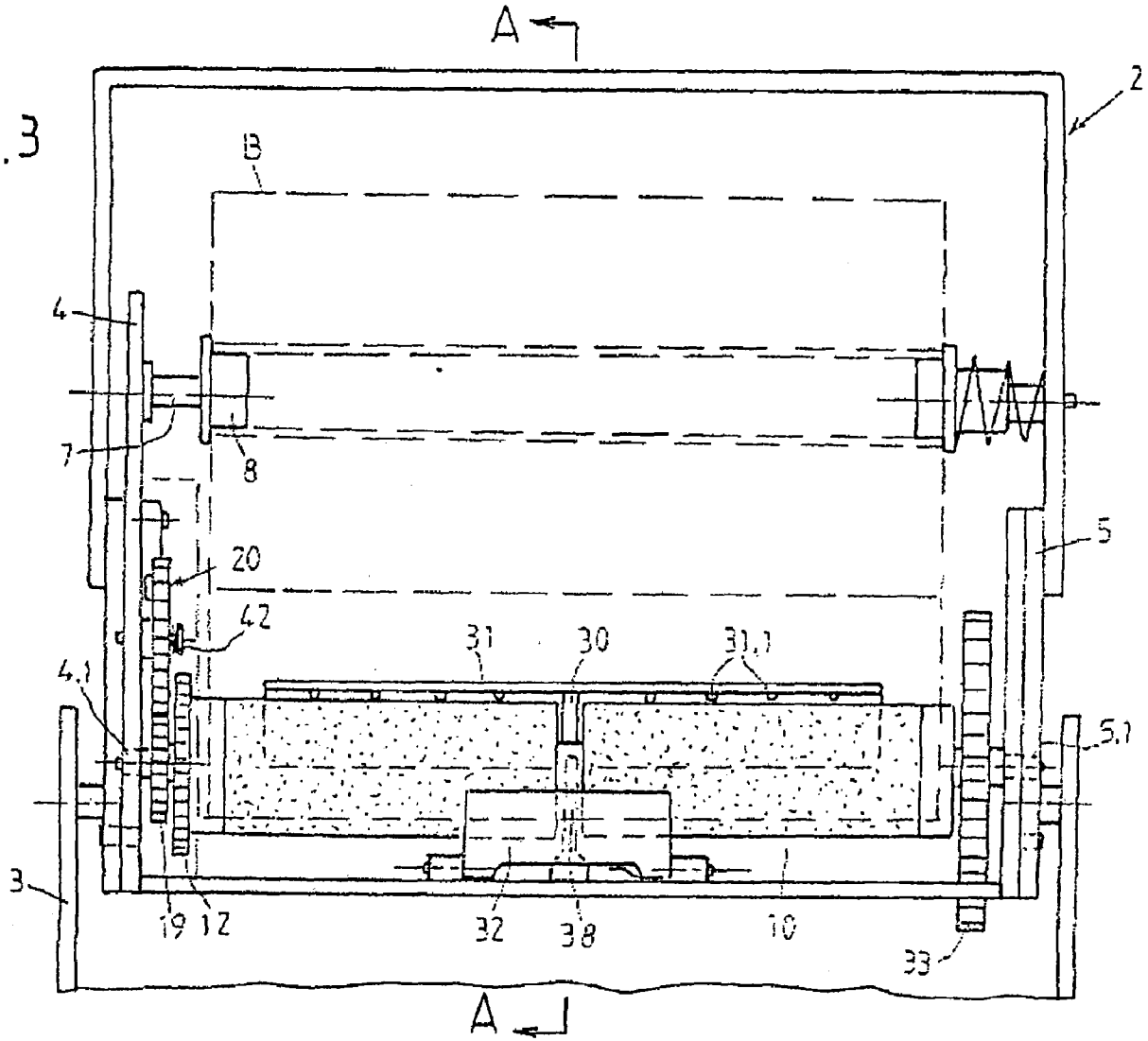
Figure 6:
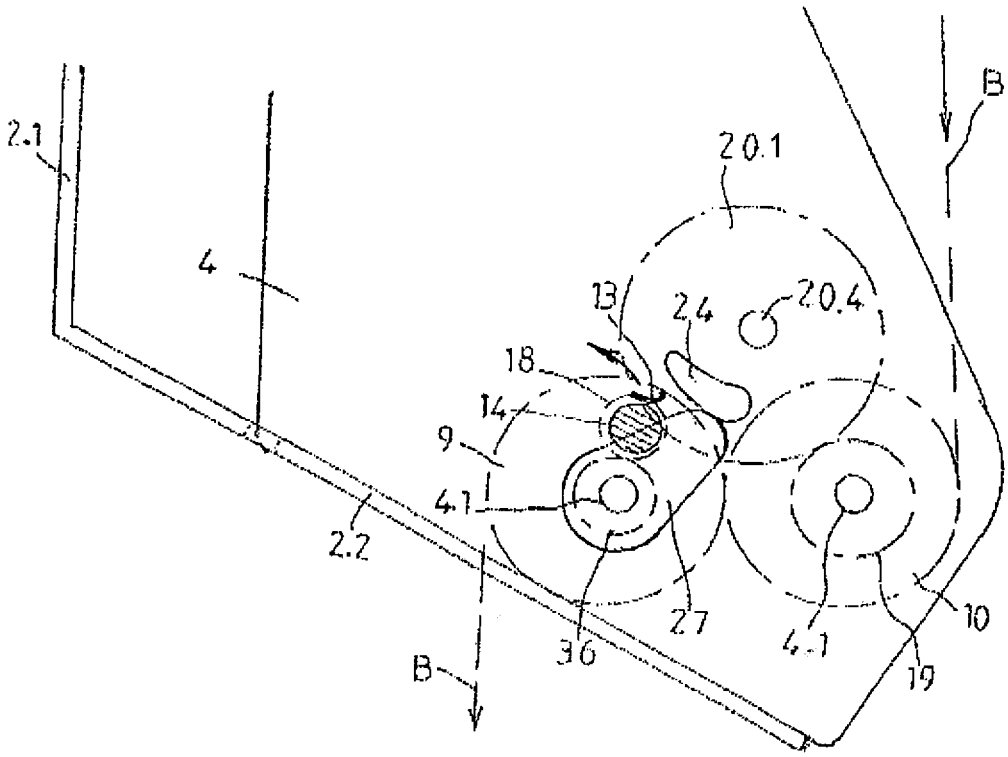

The invention is described in more detail below with the aid of the figures of the accompanying drawings in which:

FIG. 1 is a partial view, before mounting, of the dispensing appliance according to the invention, set up in the form of cartridges inserted into a receiving housing, FIG. 2 is a partial view, in cross section along the line A.A of FIG. 3, illustrating the travel of the strip of material in the appliance for the purpose of the cutting of said strip of material, FIG. 3 is a top view of the appliance according to FIG. 2, FIG. 4 is a partial view illustrating the use of a template for ensuring a format setting, FIG. 5 is a partial view in section, FIG. 6 is a partial view in section, illustrating the positioning of cam means used within the scope of the invention, FIGS. 7, 8, 9 and 10 are views of a diagrammatic nature, illustrating the various positions with respect to one another of two cams participating in the emergence of the cutting blade, FIGS. 11 and 12 are partial views, in section, of a format selector device in one embodiment of the invention, FIG. 13 is a partial view, in section, rear view.

In order to make the subject of the invention clearer in physical terms, it is now described in a nonlimiting way illustrated in the figures of the drawings.

The automatically cutting dispensing appliance according to the invention for wiping material is designated by (1). It makes it possible to dispense any type of material, including, in particular, paper and wadding, in uses as hand wipe paper, toilet paper and all-purpose wiping paper and in other similar uses.

This appliance has a small format, as compared with the prior art, and, in particular, it is designed in dimensions which, for example, may be of the order of 28×25×20 centimeters, while at the same time making it possible to process reels of several kilos. The appliance comprises a basic housing (2) with a back face (2.1) and a lower face (2.2) in prolongation, the latter forming a bearing plane. This housing is capable of receiving an articulated lid (3) at its face, while a key-type closing device known per se ensures the closure of the assembly as a whole.

According to the invention, the housing receives, demountably and by latching, a cartridge (c) forming a carrier structure defined by two transverse flanges (4-5) receiving various components and allowing the positioning of these in relation to one another and, in particular, of various rollers, the function of which will be specified later. The two flanges (4-5) are braced in their rear part by means of a connecting plate (6) of great length. The flange/connecting-plate assembly can be molded in one piece. In the upper part, the flanges can receive spindles (7) for the support of connectors (8), between which the reel (b) of material is arranged. At least one of the flanges can be moved elastically apart outwardly in order to make it easier to introduce the reel.

According to the invention, the lower part of the carrier structure receives two drums (9-10) which are arranged side by side, but without direct contact between them, and the ends (9.1-10.1) of which are mounted in holes (4.1-5.1) formed on the abovementioned flanges. The two drums are nevertheless associated with one another, since they each receive, at one of their ends which are located in the same side, a first and a second toothed ring (11-12) which mesh with one another. The first drum (9) is called a blade carrier drum, while the second (10) is called a guide drum.

The drum (9) arranged at the rear is internally hollow and receives a culling blade (13) produced in one or two parts and articulated on a blade carrier arm (14). This culling blade is characterized by a twisted shape of the whole of its teeth, making I possible to have an effect of progressive penetration of the blade into the material from the ends toward the central zone of the latter. Each tooth is advantageously located in a plane perpendicular to the longitudinal axis of the drum. More particularly, as illustrated in the drawings, the cutting blade is designed in two parts (13.1, 13.2) fastened to the blade carrier arm (14) by means of screws of otherwise. The two blade parts meet toward the central part of the drum (9), while at the same time leaving a space (e) corresponding, in practice, to a cradle (15) for supporting the blade carrier arm with respect to the inner bottom of the drum. This cradle has an indentation allowing the arm to rotate on itself. At the termination of the arm, one end (14.1) of the latter has a projecting abutment (16) which comes into contact with stroke-limiting bearing planes (17) formed on the transverse face (9.2) of the drum. The other end (14.3) of the arm receives a notched collar or pinion (18) adjacent to the first toothed ring (11), as recalled above. The notched collar is mounted rotatably together with the arm. The function of this notched collar will be specified later.

The second guide drum (10) has, in its central part, a radial cavity (10.2) which is in the prolongation of the cradle (15) for supporting the blade carrier arm (14) of the first drum (9). This second drum (10) receives at the end a second fixed toothed ring (12) cooperating with the first fixed ring (11) in the first drum. The second drum has a spindle (10.1) capable of coming into engagement in a bearing-forming recess made in the lower part of the opposite flange. The spindle is capable, moreover, of receiving, between the second toothed ring (12) and the flange, a third toothed ring (19) of small diameter which is capable of cooperating with a complementary fourth toothed ring (20) mounted on the opposite flange (4). This fourth toothed ring (20) is of larger diameter in a much higher dimensional ration, and comprising a number of teeth corresponding to the dimension of the format of the strip of material to be cut. The fourth toothed ring (20) is capable of cooperating with a no-return pawl (22) mounted on a pin (23) fastened to the flange (4) together with an abutment (22.1). The fourth toothed ring (20) receives, on its face (20.1) opposite the flange, a profiled fixed cam (24), the function of which will be described later. The fourth ring (20) has, on its face (20.2) toward the drums (9-10), an orifice (20.3) allowing the positioning of a finger (342.1) of a link (42) in the other end (42.2) which makes it possible to fasten a return spring (26), the other end of which is integral with a fixed point (25) formed on the flange (4). The link thus ensures an eccentric function during the rotation of the ring (20) counter to the return spring (26), at the same time forming the mechanism for starting the rotation of the drums (9-10).

According to another feature, the shaft (9.1) of the drum (9) is prolonged on the flange side so as to receive a movable cam (27) articulated on the shaft, this cam being profiled in a specific way in order to cooperate, in certain operating phases, with the abovementioned first cam (24).

According to another feature of the invention, the two drums (9-10) have, near their respective first and second toothed rings (11-12), two recesses (47), opposite or not allowing the temporary insertion of a template-forming caliper (29), the end of which is designed in the form of a fork so as to penetrate into the recesses (47). The function of this caliper is to make it possible to set the various toothed rings in position in relation to one another as a function of the format of the strip of material to be dispensed. This template has a spindle (29.1) capable of engaging into the central axial orifice (20.4) of the ring (20). This template also has an index (29.2) engaging into an orifice (20.5) formed on the ring (20). This orifice is arranged in a special way for format selling. It defines the position of the toothed ring (20) supporting the fixed cam (24), this being in relation to another movable cam (27) which will also be described.

According to another feature, the drum (10) is capable of receiving in its radial cavity (10.2), with free and controlled articulation, a fork-shaped attached tab (30) integral with an upper flap (31), this flap being capable, after the positioning of the tab by latching on the drum (10), of covering the drum (9) completely and the drum (10) partially. This flap has on the inside uniformly arranged projecting ribs (31.1), the function of which is to ensure the guidance of the strip of material during cutting.

According to another feature, a lower flap (32) is mounted so as to be articulated from a front spacer bar (43) formed between the flanges (4-5). This lower flap has a curved shape capable of substantially surrounding the drum (10) over an angular sector and from underneath the drum (10). This flap opens at the front of the appliance and allows the introduction and guidance of the free end of the strip of material coming from the reel.

According to another feature, the drum (9) has, at the termination of its shaft, on the opposite side to said toothed rings, a bearing surface (9.5) capable of receiving fixedly a large-diameter loading wheel (33) projecting externally from the cartridge and from the appliance, in order to allow manual control for the user to carry out the loading or fault correction of the reel of material to be dispensed.

Referring to the drawings, in particular FIG. 2, the travel of the strip of material has been illustrated.

The reel of material can be put in place between the supporting flanges in one direction or the other, that is to say the strip unwound from the reel is located either at the front of the appliance, as illustrated in FIG. 2, or toward the rear of the latter (not illustrated). Said strip is then introduced between the roller (10) and the retractable lower flap (32), at the same time passing in front of the appliance, and then the strip is introduced and guided so as to pass between the two drums (9-10) in order to be would partially onto the drum (9) comprising the cutting device. A guide (38) integral with the front space bar (430 ensures the upward return of the strip of material between the drums (9-10). The strip of material emerges at the rear of the appliance, at the same time being guided by the articulated flap (31).

According to another feature, the blade carrier arm (14) receives, at the termination of its end, the pinion (18) which is capable of cooperating with a complementary pinion (36) formed laterally on the movable cam (27). Thus, the displacement and emergence of the cutting blade give rise, in parallel and simultaneously, to the positioning of the movable cam under the conditions which will be explained below with reference to drawings 7, 8, 9 and 10.

The movable cam (27) has a specific configuration, with a semicircular rear part (27.*a*) prolonged by a first rectilinear slope (27.*b*) and a second rectilinear slop (27.*c*), but oriented angularly with respect to the first slope, so as to approximate a beak shape (27.*d*) continued by a connecting line (27.*e*) to the rear part of the cam.

The fixed cam (24) arranged eccentrically on the fourth inner ring is of smaller dimension and is bean-shaped, in particular with a rectilinear base (24.1).

It is appropriate, at this juncture, to describe the functioning of the appliance.

The loading of the reel involves introducing the free end of the latter between the retractable lower flap (32) and the drum (10) which, for this purpose, advantageously has a gripping surface. The strip is guided between the two drums (9-10), and then, by virtue of the bearing effect of the upper flap (31), said strip is wound partially around the drum (9) so as to emerge behind the latter. In the initial state, the cutting blade is integrated in its drum (9), without emerging. The return spring is not subjected to extension stress. When the strip of material is pulled by the user, this gives rise progressively and simultaneously to the rotation of the drum (9) which meshes with the drum (10) by means of respective first and second rings (11-12). The third ring (19), adjacent to the second ring (12), causes the rotation of the fourth ring (20). The no-return pawl, penetrating into the teeth of the ring (20), locks the mechanism in position, while preventing a return into position. The fourth ring (20) rotates. The connecting and fastening point of the link (42) moves away, at the same time causing the extension of the return means (26) until the latter exceeds a dead center corresponding to the maximum distance of the fastening point of the link with respect to the fixed fastening point formed on the flange. The rotation of the toothed ring (11) simultaneously brings about the rotation of the notched collar (18) mounted on the blade carrier arm and therefore the progressive emergence of the cutting blade from the drum (9). In practice, the emergence of the culling blade takes place at the termination of the second revolution of the drum (9) on itself, in particular with regard to a format of 25 centimeters. At maximum dead center, the cutting blade has fully emerged, and the exceeding of dead center causes the return of the mechanism and of the cutting blade into the initial position, along with a corresponding cutting of the strip of material.

The retraction of the cutting blade takes place as a result of the contact of the two teeth (13.3) brought closer together near the middle zone of the drum. These two teeth come into perpendicular contact with two abutments (41) which are made from rubber which, by virtue of a counterbearing effect, allow the blade carrier to tilt rearward on itself, along with the pivoting of the blades and therefore of the teeth, until they return into the drum (9).

Referring now to the two fixed (24) and movable (27) cams mentioned above, FIGS. 7, 8, 9 and 10 illustrate the various respective positions of these. In the initial situation, FIG. 7, the fixed cam is away from the movable cam, and is located substantially opposite the latter. The pull on the strip of material causes the tiling of the movable cam until the position in FIG. 8 is reached. In this situation, the cutting blade remains retracted in the drum. Alter the use continues with the manual pull, the two cams come into contact with one another, FIG. 9, and the movable cam temporarily becomes fixed. The outer curved part of the fixed cam comes into contact with the second rectilinear zone of the movable cam, said second rectilinear zone being adjacent to the beak. The continuation of the pulling movement gives rise progressively to the escape of the movable cam until their two beaks come opposite one another and correspond to the maximum emergence of the cutting blade (FIG. 10). The cams resume their initial position after dead center is passed in this way.

It is now appropriate to explain another particular feature of the invention which makes it possible to vary the format of the strip of material to be cut.

A first possibility involves arranging on the drum (10) a toothed ring (12) defined with a suitable number of teeth for the selected format, for example 25 centimeters. This corresponds to the embodiment illustrated in FIG. 1. The change of format makes it necessary to change the ring (12) for another ring having a different number of teeth, and a different dimension ratio will be obtained between the rings (20 and 12), thus making it possible to obtain a different format, for example 37 centimeters. If the ring (12) is molded together with the drum (10), it is only this component which will have to be changed, the others remaining the same. It is expedient to note that, as a function of the diameter of the ring (20), two or thee turns of the drum (9) will be necessary before the emergence of the cutting blade.

In an alternative embodiment corresponding to a second possibility, FIGS. 11 and 12 illustrate an arrangement of the appliance which allows format selection directly, without the drum (10) having to be changed.

For this purpose, the drum (10) is arranged differently so as to receive a movable spindle (10.1) capable of receiving a sliding pinion (450. The movable spindle (10.1) slides axially with respect to the drum (10), while being held at its two ends, on the one hand, by the drum itself and, on the other, by an orifice formed in the abovementioned flange (4). This drum is arranged, in its end part, with a profiled inner cavity making it possible, on the one hand, to accommodate and guide the end of the spindle (10.1) and, on the other hand, to accommodate the ring (19) in a specific position. The ring (19) is integral with the movable spindle (10.1), but within a space (1.*e*) for moving away with respect to the sliding pinion (45).

Moreover, this second embodiment requires an arrangement of the toothed ring (20). The latter is then associated with a fifth toothed ring (21) having a number of teeth different from that of the ring (20). The no-return hook (22) cooperates with the fifth ring (21), and the fixed cam (24) is integral with the inner face of the ring (21).

Moreover, the movable spindle (10.1) has a radial finger or index (10.1*b*) which forms the push element of said spindle so as to present the pinions (45 and 19) in the suitable way, as illustrated in FIGS. 11 and 12. According to FIG. 11, corresponding, for example, to a format of 25 centimeters, the ring (19) cooperates with the ring (20). The sliding pinion (45) is pushed back toward the flange (4). For the purpose of selecting a different format, for example 37 centimeters, the operator pushes the index so as to cause the displacement of the movable spindle (10.1). In this situation, the sliding pinion (45) comes into contact with the ring (21), while the pinion (19) is integrated into the inner recess of the drum (10), without any effect.

In this embodiment, the selector mechanism requires prior setting by the operator.

The advantages emerge clearly from the invention. The novel design of the dispensing appliance is stressed, offering, in a reduced volume, an automatic dispensing of strips of material, along with a simplification of the mechanisms used. The reel can be presented by the operator responsible for maintenance in any direction in the appliance. A standardized design of cartridges may be considered, with a set of mechanisms allowing a dispensing of formats according to a first length, for example 25 centimeters, and another cartridge making it possible, by suitable means, to dispense material according to another format, for example 37 centimeters. It is then sufficient to change the cartridge. The two cartridges are identical, with the exception of one of the toothed rings, to be precise the fourth which defines the number of teeth in relation to the paper format. Alternatively, a selector device may be integrated in the cartridge, but it is then necessary, each time, for the operator to carry out settings and therefore manipulations.

The invention claimed is:

1. An automatically cutting dispensing appliance for wiping material, comprising a basic housing with a back face and a lower face, the basic housing receiving an articulated lid, wherein the housing receives, demountably by latching, a cartridge defining a carrier structure comprising two transverse flanges, a connecting plate arranged between said flanges, and a front spacer bar, the flanges receiving, in an upper part, connectors for supporting a reel of material and, in a lower part, two drums arranged side by side, a first drum being a blade carrier drum, a second drum being a guide drum, and said drums have respective first and second toothed rings at one of their ends facing one another to allow the drums to connect to each other and to rotate with respect to one another, and the second drum receives a third toothed ring cooperating with a mechanism for starting rotation of the drums, said mechanism including a fixed cam, and wherein a blade carrier arm has transmission means having a movable cam allowing emergence of a cutting blade from said first drum, and the fixed cam and movable cam cooperate with one another, at the same time defining a path of movement of the culling blade, and further comprising flaps for guiding of a strip of material toward the cutting blade, wherein the strip of material is cut.

2. The automatically cutting dispensing appliance for wiping material, as claimed in claim 1, wherein the first drum is arranged at a rear of the appliance and is internally hollow and receives the culling blade, the cutting blade has two parts integral with the blade carrier arm, and said blade parts meet toward a central part of the first drum, at the same time leaving a space for positioning a cradle for supporting the blade carrier arm, and said blade parts are designed according to a twisted profile.

3. The automatically cutting dispensing appliance for wiping material, as claimed in claim 2, wherein the blade carrier arm has, at one end, an abutment in contact with stroke-limiting bearing planes formed on a transverse face of the first drum, and another end of said arm has a notched collar adjacent to the first ring.

4. The automatically cutting dispensing appliance for wiping material, as claimed in claim 1, wherein the second, guide drum has, in its central part, a radial cavity allowing fastening by latching of a flap mounted movably about said cavity wherein the flap covers at least the first drum.

5. The automatically cutting dispensing appliance for wiping material, as claimed in claim 4, wherein the flap has a fork-shaped attached tab capable of being latched in the radial cavity of the second drum, the flap having, on an inside, projecting ribs ensuring guidance of the strip of material with respect to the first drum.

6. The automatically cutting dispensing appliance for wiping material, as claimed in claim 1, wherein the second drum has a spindle, an end of the spindle is engaged in a recess formed in an opposite flange, said spindle receiving the third toothed ring, said third toothed ring being of small diameter and cooperating with a fourth toothed ring forming the mechanism for starting rotation of the drums in order to dispense strips of material.

7. The automatically cutting dispensing appliance for wiping material, as claimed in claim 6, wherein the fourth toothed ring has, according to a set diameter, a number of teeth corresponding to a format of strip of material to be cut, said fourth ring, on one of its faces, receiving the fixed cam and, on another face, allowing fastening of a link associated with a return spring and ensuring an eccentric function during rotation of the fourth ring counter to said return spring.

8. The automatically cutting dispensing appliance for wiping material, as claimed in claim 7, wherein a shaft of the first drum is prolonged to receive the movable cam articulated on the shaft, said cam being profiled in order to cooperate, in certain operating phases, with the fixed cam arranged on the fourth ring, and a complementary pinion is arranged on the movable cam to cooperate with a pinion mounted on the blade carrier arm, in order to ensure displacement and emergence of the cutting blade.

9. The automatically cutting dispensing appliance for wiping material, as claimed in claim 1, wherein a lower flap is mounted to be articulated from the front spacer bar, said lower flap opening at a front and allowing introduction and guidance of a free end of the strip of material coming from the reel.

10. The automatically cutting dispensing appliance for wiping material, as claimed in claim 1, wherein the first drum has, at a termination of a shaft, on an opposite side to the toothed rings, a bearing surface receiving fixedly a large-diameter loading wheel projecting externally from the cartridge and from the appliance, in order to allow loading of the appliance or fault correction.

11. The automatically cutting dispensing appliance for wiping material, as claimed in claim 1, wherein the front spacer bar receives a guide ensuring upward return of the strip of material between the drums, said strip of material emerging at a rear of the appliance, at the same time being guided by an articulated flap.

12. The automatically cutting dispensing appliance for wiping material, as claimed in claim 1, wherein the movable cam has a semicircular rear part prolonged by a first rectilinear slope, a second rectilinear slope, a beak shape and a connecting line to the rear part of the moveable cam, and the fixed cam is bean-shaped with smaller dimension and with a rectilinear base, the movable cam and the fixed cam cooperating during emergence of the cutting blade.

13. The automatically cutting dispensing appliance for wiping material, as claimed in claim 1, wherein the front spacer bar is provided with two rubber abutments defining a counterbearing and allowing teeth of the blade which are close to one another to come to bear in order to ensure rearward tiling of the blade carrier on itself and its retraction into the first drum.

14. The automatically cutting dispensing appliance for wiping material, as claimed in claim 1, wherein the second toothed ring is provided with a number of teeth corresponding to a format, and change of format requires change of the second toothed ring for another ring having a different number of teeth.

15. The automatically cutting dispensing appliance for wiping material, as claimed in claim 6, wherein the second drum is arranged so as to receive a movable spindle receiving, on one hand, the third toothed ring and, on an other hand, a sliding pinion, and the fourth toothed ring is associated with a fifth toothed ring with a different number of teeth, and positioning of the spindle with respect to the second drum defines situations of engagement between the third and fourth rings, on the one hand, and the sliding pinion and the fifth ring, on the other hand, and the spindle receives an index allowing the positioning of said spindle.

16. The automatically cutting dispensing appliance for wiping material, as claimed in claim 15, wherein the fifth ring receives the fixed cam.

17. The automatically cutting dispensing appliance for wiping material, as claimed in claim 15, wherein a no-return hook fastened to a first of the flanges cooperates either with the fourth ring or with the fifth ring as a function of format selection conditions of the appliance.

18. The automatically cutting dispensing appliance for wiping material, as claimed in claim 15, wherein the drums have, near the first and second toothed rings, recesses allowing insertion of a template-forming caliper making it possible to set said first and second rings in relation to one another as a function of format of the strip of material to be dispensed, said caliper having a spindle engaging into a central axial orifice of the fourth ring and an index engaging into an orifice formed on the fourth ring.

19. The automatically cutting dispensing appliance for wiping material, as claimed in claim 1, wherein the connectors receive a reel of material with a hanging end of material located either toward a front of the appliance or toward a rear of the appliance, said end being guided between the second drum and a flap, subsequently conveyed between the drums, and then discharged toward the rear of the appliance by the first drum.

* * * * *

UNITED STATES PATENT AND TRADEMARK OFFICE

CERTIFICATE OF CORRECTION

PATENT NO. : 7,234,381 B2
APPLICATION NO. : 10/766509
DATED : June 26, 2007
INVENTOR(S) : Granger It is certified that error appears in the above-identified patent and that said Letters Patent is hereby corrected as shown below:

Col. 4, Line 33: insert --respectively-- after "toothed ring (11-12)"

Col. 5, Line 51: insert --respectively-- after "toothed ring (11-12)"

In The Claims:

Claim 13, col. 9, line 12: delete "tiling" and insert -- tilting --

Signed and Sealed this

Twenty-first Day of August, 2007

JON W. DUDAS
*Director of the United States Patent and Trademark Office*